US011988074B2

(12) United States Patent
Wu et al.

(10) Patent No.: US 11,988,074 B2
(45) Date of Patent: May 21, 2024

(54) SUCTION CYLINDER EXPLOITATION DEVICE AND METHOD FOR MARINE NATURAL GAS HYDRATES

(71) Applicant: FU ZHOU UNIVERSITY, Minhou Fujian (CN)

(72) Inventors: Xuezhen Wu, Minhou Fujian (CN); Dayong Li, Minhou Fujian (CN); Yujing Jiang, Minhou Fujian (CN)

(73) Assignee: FU ZHOU UNIVERSITY, Minhou Fujian (CN)

( * ) Notice: Subject to any disclaimer, the term of this patent is extended or adjusted under 35 U.S.C. 154(b) by 0 days.

(21) Appl. No.: 17/272,929

(22) PCT Filed: Jan. 4, 2021

(86) PCT No.: PCT/CN2021/070113
§ 371 (c)(1),
(2) Date: Jun. 23, 2022

(87) PCT Pub. No.: WO2022/126801
PCT Pub. Date: Jun. 23, 2022

(65) Prior Publication Data

US 2023/0304383 A1 Sep. 28, 2023

(30) Foreign Application Priority Data

Dec. 18, 2020 (CN) ..... 202011506719.4

(51) Int. Cl.
*E21B 41/00* (2006.01)
*E21B 7/18* (2006.01)
(Continued)

(52) U.S. Cl.
CPC ..... *E21B 41/0099* (2020.05); *E21B 7/185* (2013.01); *E21B 21/001* (2013.01);
(Continued)

(58) Field of Classification Search
CPC .... E21B 41/0099; E21B 7/185; E21B 21/001; E21B 33/127; E21B 43/08; E21B 43/128;
(Continued)

(56) References Cited

U.S. PATENT DOCUMENTS 3,916,993 A * 11/1975 Katz ..... E21B 43/2401 166/248
2003/0214175 A1* 11/2003 Baciu ..... E21C 45/00 299/8
2018/0305894 A1* 10/2018 Vaughan ..... E21B 43/36

FOREIGN PATENT DOCUMENTS

CN 108104776 A 6/2018
CN 110359843 A 10/2019

OTHER PUBLICATIONS

Finite Element Analysis of Soil Plug Formation in the Process of Suction Anchor Settlement Liu Junbin et al., Water Science and Engineering Technology, Issue 3, 2007, pp. 39-42.
(Continued)

*Primary Examiner* — James G Sayre
(74) *Attorney, Agent, or Firm* — Jose Cherson Weissbrot

(57) ABSTRACT

The invention discloses a suction cylinder exploitation device and method for marine natural gas hydrates. The exploitation device comprises an exploitation cylinder, a water pump, a sand control device, a liquid-gas filling system and the like. Through the specially-designed exploitation cylinder and mating devices thereof, the exploitation cylinder can sink below a seabed surface to exploit natural gas hydrates deep below the seabed surface and can be withdrawn. A series of problems such as high well drilling and completion cost of traditional deep-sea drilling exploitation methods, and damage, collapses and sand generation of plain concrete wellbores under the effect of formation pressure are solved, and the limitations that traditional capping depressurization methods can only exploit subma-
(Continued)

rine superficial hydrates and are low in exploitation efficiency are overcome. The invention can greatly reduce the exploitation cost of natural gas hydrates deep below the seabed surface and is of great significance for commercial exploitation of marine natural gas hydrates.

9 Claims, 7 Drawing Sheets

(51) Int. Cl.

| | |
|---|---|
| ***E21B 21/00*** | (2006.01) |
| ***E21B 33/127*** | (2006.01) |
| ***E21B 43/08*** | (2006.01) |
| ***E21B 43/12*** | (2006.01) |
| ***E21B 43/24*** | (2006.01) |

(52) U.S. Cl.
CPC ..... *E21B 33/127* (2013.01); *E21B 43/08* (2013.01); *E21B 43/128* (2013.01); *E21B 43/2401* (2013.01)

(58) Field of Classification Search
CPC ..... E21B 43/2401; E21B 43/00; E21B 43/01; E21B 33/1208; E21B 43/121; E21B 43/122
See application file for complete search history.

(56) References Cited

OTHER PUBLICATIONS

Introduction to Oil and Gas Resources Development, Yang Ke et al., p. 159, China University of Mining and Technology Press, 1st edition.

* cited by examiner

SUCTION CYLINDER EXPLOITATION DEVICE AND METHOD FOR MARINE NATURAL GAS HYDRATES

CROSS REFERENCE TO RELATED APPLICATIONS

This application is the national phase entry of International Application No. PCT/CN2021/070113, filed on Jan. 4, 2021, which is based upon and claims priority to Chinese Application No. CN 202011506719.4, filed on Dec. 18, 2020, the entire contents of which are incorporated herein by reference.

BACKGROUND OF THE INVENTION

1. Technical Field

The present invention relates to a suction cylinder exploitation device and method for marine natural gas hydrates.

2. Description of Related Art

It has been considered that natural gas hydrates have a great potential to replace traditional energy such as petroleum, coal and natural gas because of their huge reserves. Natural gas hydrates are exploited based on the principles of depressurization, thermal excitation, displacement with chemical reagents, solid fluidization, and combined application of the above single methods. It is commonly believed at present that the depressurization method and other improved solutions based on the depressurization method may be the optimum approach for realizing industrial pilot productions of the marine natural gas hydrated, and other methods are used to assist the pressurization method in increasing the output or stabilizing gas production.

Regarding specific implementations of natural gas hydrate exploitation, existing exploitation methods include drilling methods and superficial exploitation methods. The drilling methods realize natural gas hydrate exploration as follows: an offshore drilling ship drills a well on the seabed of a deep sea, and then the pressure in a wellbore is reduced to realize exploitation by pressurization or solid fluidization. Such methods can exploit natural gas hydrates 10 m/500 m deep below the seabed. The superficial exploitation methods are implemented in the following a manner: an exploitation machine or device is directly lowered to the surface of the seabed to directly collect massive natural gas hydrates or natural gas converted from the massive natural gas hydrates by local depressurization of a protection hood. Such methods are mainly used to exploit natural gas hydrates several meters below the surface of the seabed.

Exploitation methods based on the drilling technology include: (1) exploitation methods based on drilling depressurization: "Ye Jiang Liang Main progress of the second gas hydrate trial production in the South China Sea, Geology in China, 2020", "CN107676058B—Mortar replacement exploitation method and device for marine natural gas hydrates", "CN109763794B—Multi-branch horizontal well depressurization and heating united mining method for marine hydrates", "CN101672177B—Exploitation method for submarine natural gas hydrates", etc.; (2) exploitation methods based on drilling solid-fluidization: "Zhou Shou Wei et al., Optimal design of the engineering parameters for the first global trial production of marine natural gas hydrates through solid fluidization, Natural Gas Industry. 2017", "CN106939780B—Device and method for solid-fluidization mining of submarine superficial non-diagenetic natural gas hydrates", "CN110700801B—Automatic jet crushing tool for solid-fluidization mining of natural gas hydrates", etc.

Up to now, around the world, Japan has successfully carried out two times of trial productions of marine natural gas hydrates through the drilling depressurization method, and China has successfully carried out two trial productions of marine natural gas hydrates through the drilling depressurization method and one time of trial production of marine natural gas hydrates through the drilling solid-fluidization method, and all these trial productions were based on the drilling exploitation technique. However, the decomposition of natural gas hydrates around the wellbore may lead to a drastic reduction of reservoir strength, a large amount of silt will surge out of the stratum under the effect of huge crustal stress, which in turn results in instability of the wellbore, and thus, it is impossible to realize long-term stable exploitation. This problem happened to multiple times of trial productions of marine natural gas hydrates carried out at home and abroad. In addition, the value of natural gas produced by the exploitation methods based on the drilling technology is far from reaching the drilling cost, so commercial exploitation has not be realized yet, at present.

Techniques based on the superficial exploitation methods include: (1) capping pressurization methods; "Li Wei et al., Study on exploitation mechanism of capping pressurization device for natural gas hydrates, Chinese Journal of Applied Mechanics. 2020", "CN105781497A—Collection device for submarine natural gas hydrates", "CN111648749A—Movable riser-type exploitation system and method for submarine superficial natural gas hydrates", etc. All these methods collect natural gas hydrates or decomposed products thereof through a conical cap device arranged on the seabed. (2) Mechanical collection methods: "CN103628880B—Environmentally-friendly exploitation method for natural gas hydrates in superficial non-diagenetic stratum on deep seabed", "CN104265300B—Exploitation method and device for submarine superficial natural gas hydrates", "CN104948143B—Exploitation method and device for submarine superficial natural gas hydrates", etc. All these methods collect massive natural gas hydrates through a mining machine arranged on the seabed.

The techniques based on the superficial exploitation theory still remain at the theoretical exploration stage. Due to the fact that only a small proportion of natural gas hydrates are directly hoisted on the surface of the seabed and are dispersed on the seabed, the production efficiency is lower than expected production efficiency, and the application range of these methods is limited.

BRIEF SUMMARY OF THE INVENTION

To solve the problems of existing exploitation techniques based on drilling pressurization, the invention provides a low-cost and high-efficiency depressurizing exploitation device and method according to the characteristic that marine natural gas hydrates typically occur in clayey sand or silty sediments, The exploitation device and method can exploit submarine non-superficial natural gas hydrates and can carry out depressurizing exploitation deep under the sea without drilling.

The solution adopted by the invention to solve the technical problems is as follows: a suction cylinder exploitation device for marine natural gas hydrates comprises an exploitation cylinder capable of sinking into a stratum below a seabed, a water pump, a sand control device and a gas-liquid lifting system, wherein:

The exploitation cylinder is a cylindrical structure with an upper side scaled and a lower side not sealed, and comprises a top plate and a vertical cylinder wall; the water pump is communicated with an inner cavity of the cylinder body of the exploitation cylinder and is able to discharge liquid out of the exploitation cylinder to reduce the pressure in the exploitation cylinder to control the exploitation cylinder to sink in the stratum to enter, together with the sand control device and the gas-liquid lifting system, a natural gas hydrate reservoir and/or a natural gas hydrate and free gas mixture reservoir and/or a free natural gas reservoir below the seabed;

At least one cavity is formed between the exploitation cylinder and the sand control device, and the sand control device allows liquid and/or gas to pass through to enter the cavity and is able to filter out silt; the cavity is communicated with at least one channel;

The gas-liquid lifting system comprises at least one lifting power device, which has one end connected to the cavity and the other end connected to an offshore processing system, and is used to lift the liquid and/or gas in the cavity; when the liquid and/or gas is lifted, the pressure in the cavity is reduced to reduce the pressure of the stratum around to promote natural gas hydrates to be decomposed into water and natural gas, which enter the cavity through the sand control device under the effect of a pressure difference, so that exploitation of the natural gas hydrates is realized.

Furthermore, the channel includes a water pipe and a gas pipe; the water pipe has one end connected to the lifting power device and the other end connected to an upper portion of the exploitation cylinder; the gas pipe has one end connected to the cavity and the other end connected to an upper portion of the exploitation cylinder to collect gas; under the effect of formation pressure and gravity, formation fluid enters the cavity, the liquid in the cavity flows downward and is pressed into the water pipe to he lifted by the lifting power device; the gas in the cavity flows upwards through the gas pipe; the lifting power device is an electric pump, and the electric pump is an electric immersible centrifugal pump, an electric immersible screw pump, a mud pump, or a combination of these three pumps.

Furthermore, the cavity is formed in an outer side of the vertical cylinder wall of the exploitation cylinder; the exploitation cylinder has a perforated pipe wall, and a hole is formed in the perforated pipe wall; the sand control device is arranged in the hole and/or covers the hole; the perforated pipe wall has a permeable and protective function, allows liquid and gas to pass through, and protects the sand control device against erosion damage from the formation pressure and fluid; and the gas and liquid enter the cavity in the outer side of the vertical cylinder wall through the perforated pipe wall and the sand control device.

Furthermore, the cavity is formed in an internal space of the exploitation cylinder, the stratum in the internal space is cleared out of the cylinder through a jet drilling system, and the cavity is defined by the top plate, the vertical cylinder wall and a sealing bottom of the exploitation cylinder; a hole is formed in a lower portion of the vertical cylinder wall, and the sand control device is arranged in the hole and/or covers the hole; a vertical well wall at this position has a permeable and protective function, allows liquid and gas to pass through, and protects the sand control device against erosion damage from the formation pressure and fluid; and the gas and liquid enter the cavity in the internal space of the exploitation cylinder through the vertical well wall and the sand control device.

Furthermore, the jet drilling system comprises a telescopic arm fixed to a lower side of the top plate, a dulling jig, a jet system and a mud pumping system, wherein the telescopic has a telescopic end and is able to drive the drilling jig, a lower end of the jet system and a lower end of the mud pumping system to move vertically; the drilling jig is fixed to a lower end of the telescopic end, and the jet system comprises a jet pipe penetrating through the telescopic arm to extend to the drilling jig; the drilling jig and the jet system are able to crush the stratum in the internal space of the exploitation cylinder into rock debris; the mud pumping system is used to pump the rock debris out of the exploitation cylinder and comprises a mud pump fixed to the telescopic end, and the mud output pipe extending to a position above the top plate of the exploitation cylinder is disposed at a discharge end of the mud pump; when the exploitation cylinder sinks to a desired position in the stratum and the stratum in the internal space of the exploitation cylinder is cleared out of the cylinder, the jet system is controlled to jet curing materials which are able to seal a bottom of the cylinder to form the sealing bottom; and the mud pump is used as the lifting power device to discharge the liquid out of the cavity through the mud output pipe, and the gas in the cavity flows upwards through the gas pipe.

Furthermore, the exploitation device further comprises a jet injection system which comprises an injection pump, a pipe embedded in the exploitation cylinder, and jet orifices formed in an outer surface of the exploitation cylinder and communicated with the jet pipe, wherein the injection pump jets water, hot seawater, carbon dioxide or a chemical inhibitor to the stratum via the jet orifices through the jet pipe.

Furthermore, the exploitation device further comprises an expansion hag sealing system which comprises a water-filling expansion bag and a water injection system, wherein the water injection system injects water into the water-filling expansion bag, and the water-filling expansion bag is circular, is fixed to an upper portion of the periphery of the exploitation cylinder, and is closely attached to the natural gas hydrate reservoir after being filled with water.

Furthermore, the exploitation device further comprises an auxiliary heating system which comprises an electromagnetic induction coil and an electromagnetic heating controller, wherein the electromagnetic induction coil surrounds the cylinder body of the exploitation cylinder, and the electromagnetic heating controller controls the electromagnetic induction coil to heat the exploitation cylinder, so that the natural gas hydrate reservoir is heated on a large scale.

Furthermore, the exploitation device further comprises an extensive exploitation system which is a vertical feeler lever fixed to the bottom of the exploitation cylinder, and the feeler lever is composed of a permeable pipe wall, the sand control device arranged in the permeable pipe wall, and a flow passage located in the middle of the sand control device; the submerged depth of the feeler lever is greater than that of the exploitation cylinder to guide deeper formation fluid to enter the cavity, so that the exploitation range is expanded, and the exploitation efficiency is improved; and an electric cylinder or a hydraulic cylinder is arranged to drive the feeler lever to move vertically.

The present invention further provides a suction cylinder exploitation method for marine natural gas hydrates, which adopts the exploitation device mentioned above and comprises the following steps:

(1) selecting an exploitation area, dragging the exploitation cylinder into the exploitation area by means of an offshore transport device, and lowering the exploitation cylinder on the seabed through a rope and buckling on the seabed;

(2) discharging liquid out of the exploitation cylinder by the water pump to reduce the pressure in the exploitation cylinder, so that the exploitation cylinder sinks under the effect of the pressure difference to enter, together with the gas-liquid lifting system and the sand control device, the natural gas hydrate reservoir and/or the natural gas hydrate and free gas mixture reservoir and/or the free natural gas reservoir below the seabed;

(3) by the gas-liquid lifting system, the liquid and/or gas in the cavity defined by the exploitation cylinder and the sand control device to reduce the pressure in the cavity, so that the pressure of the stratum around is reduced to promote the natural gas hydrates in the stratum around to be decomposed into water and natural gas, which enter the cavity through the sand control device under the effect of the pressure difference, and then the liquid and the natural gas are lifted out of the exploitation cylinder synchronously, so that exploitation of the natural gas hydrates is realized.

Furthermore, in case where the cavity is formed in the internal space, of the exploitation cylinder, a rock-soil body in the exploitation cylinder is crushed by the jet drilling system and is discharged out of the cylinder body when the exploitation cylinder is controlled to sink; when the exploitation cylinder sinks to a desired position in the stratum and the stratum in the internal space of the exploitation cylinder is cleared out of the cylinder, the jet system is controlled to jet curing materials that are able to seal the bottom of the cylinder to form the sealing bottom; and when exploitation is carried out after the bottom of the cylinder is sealed, the mud pump is used as the lifting power device to discharge the liquid out of the cavity through the mud output pipe, and the gas in the cavity flows upwards through the gas pipe.

Furthermore, when natural gas hydrates within a certain range are exploited or the gas production efficiency is reduced to a certain value, gas-liquid lifting is stopped, water is pumped into the exploitation cylinder by the water pump until the pressure inside the exploitation cylinder is greater than the pressure outside the cylinder; and under the effect of the pressure difference, the exploitation cylinder is pulled by the anchor cable system to rise above a mud line to be withdrawn or transferred to a new, exploitation area for exploitation.

According to the present invention, through the specially-designed exploitation cylinder and mating devices thereof, the exploitation cylinder can sink below a seabed surface to exploit natural gas hydrates deep below the seabed surface and can be withdrawn. Compared with the prior art, the present invention has the following beneficial effects: (1) a deep-sea drilling ship is not needed in the construction process, so that the problem of high well drilling and completion cost of traditional sea-deep drilling exploitation methods is solved; (2) the main part of the exploitation cylinder is made of a high-strength prefabricated structure, so that the problems that traditional concrete wellbores are prone to damage and collapses under the effect of formation pressure is solved; and the sand control device is protected by an alloy structure, so that the problem of silt generation and damage of the traditional wellbores is fundamentally solved; (3) the limitations that traditional capping depressurization methods can only exploit submarine superficial hydrates and are low in exploitation efficiency are overcome; the long vertical cylinder wall can enter, together with an exploitation system, the natural gas hydrate reservoir deep below the seabed, and the exploitation system is arranged on the vertical cylinder wall, so that compared with exploitation in a cap, the effective exploitation area can be effectively improved, and accordingly, the exploitation efficiency and output are improved. To sum up, the present invention can greatly reduce the exploitation cost of natural gas hydrates deep below the seabed surface and is of great significance for commercial exploitation of marine natural gas hydrates.

Figure 1:
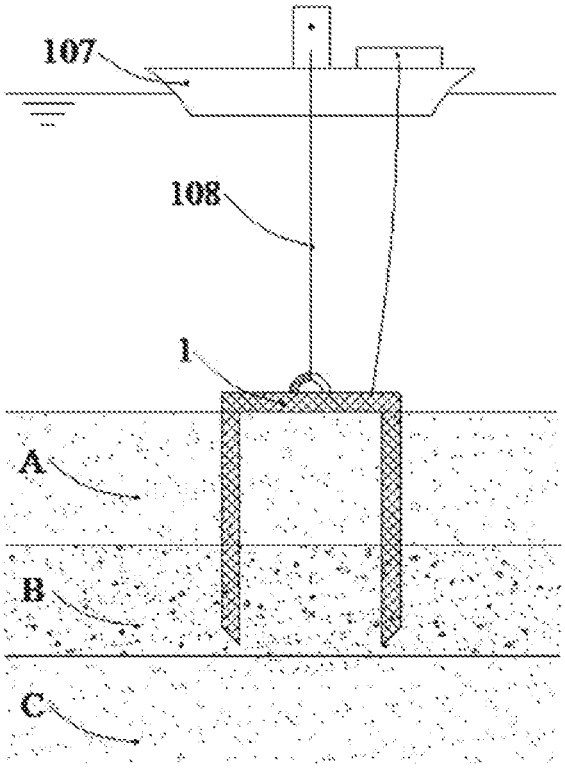
FIG. 1 is an overall schematic diagram of the suction cylinder exploitation device for marine natural gas hydrates of the present invention.

In the figures: A—overlying stratum on natural gas hydrates; B—natural gas hydrate reservoir; C—free gas reservoir below natural gas hydrate reservoir; 1—exploitation cylinder; 11—perforated pipe wall; 12—permeable support component; 13—permeable opening and cover: 14—connecting component; 2—water pump, 3—sand control device: 31—cavity; 41—lifting power device; 42—gas-liquid separation device; 51—water pipe; 52—gas pipe; 61—pipe of jet injection system; 62—jet orifice of jet injection system; 71—water-filling expansion bag;

81—electromagnetic induction coil; 91—feeler lever of extensible exploitation system: 92—electric cylinder or hydraulic cylinder of extensible exploitation system; 931—permeable pipe wall of feeler lever; 932—sand control device of feeler lever; 933—water pipe of feeler lever; 101—telescopic arm; 102—mud pump; 103—drilling jig; 104—jet system; 105—mud output pipe; 106—sealing bottom; 107—ship; 108—anchor cable system.

DETAILED DESCRIPTION OF THE INVENTION

The present invention will be further expounded below in conjunction with the drawings and specific implementations.

As shown in FIG. 1-FIG. 7, a suction cylinder exploitation device for marine natural gas hydrates comprises an exploitation cylinder 1 capable of sinking into a stratum below a seabed, a water pump 2, a sand control device 3 and a gas-liquid lifting system.

The exploitation cylinder 1 is a cylindrical structure with an upper side sealed and a lower side not sealed, and comprises a top plate and a vertical cylinder wall, wherein the water pump 2 is arranged on the top plate and is communicated with an inner cavity of a cylinder body, and liquid in the exploitation cylinder can be discharged by the water pump to reduce the pressure in the exploitation cylinder, so that the exploitation cylinder can be controlled to sink in the stratum to enter a natural gas hydrate reservoir B and/or a natural gas hydrate and free gas mixture reservoir and/or a free natural gas reservoir C, together with the sand control device and the liquid-gas lifting system;

At least one cavity 31 is formed between the exploitation cylinder and the sand control device, and the sand control device 3 allows liquid and/or gas to pass through to enter the cavity and is able to filter out silt; and the cavity has two channels, namely a water pipe 51 and a gas pipe 52.

The gas-liquid lifting system comprises a lining power device 41 and a gas-liquid separation device 42, wherein the gas-liquid separation device is arranged at an inlet of the lifting power device and is used to carry out secondary gas-liquid separation after liquid and gas are separated in the cavity by gravity, so that gas is prevented from entering the lifting power device; the gas-liquid lifting system has one end connected to the cavity and the other end connected to an offshore processing system and is used to lift the liquid and/or gas in the cavity; when the liquid and/or gas is lifted, the pressure in the cavity is reduced, and the formation pressure around is reduced to promote natural gas hydrates to be decomposed into water and natural gas, which enter under the effect of a pressure difference, the cavity again through the sand control device to he lifted to realize natural gas hydrate exploitation.

Generally, one end of the water pipe 51 is connected to the lifting power device 41, and the other end of the water pipe 51 extends out of the exploitation cylinder; one end of the gas pipe 52 is connected to the cavity 31, and the other end of the gas pipe 52 extends out of the exploitation cylinder to collect gas; under the effect of formation pressure and gravity, formation fluid enters the cavity, and the liquid in the cavity flows downwards and is pressed by the lifting power device into the water pipe to be lifted; the gas in the cavity flows upwards through the gas pipe; the lifting power device 41 is an electric pump, and the electric pump is an electric immersible centrifugal pump, an electric immersible screw pump, a mud pump, or a combination of these three pumps.

Figure 2:
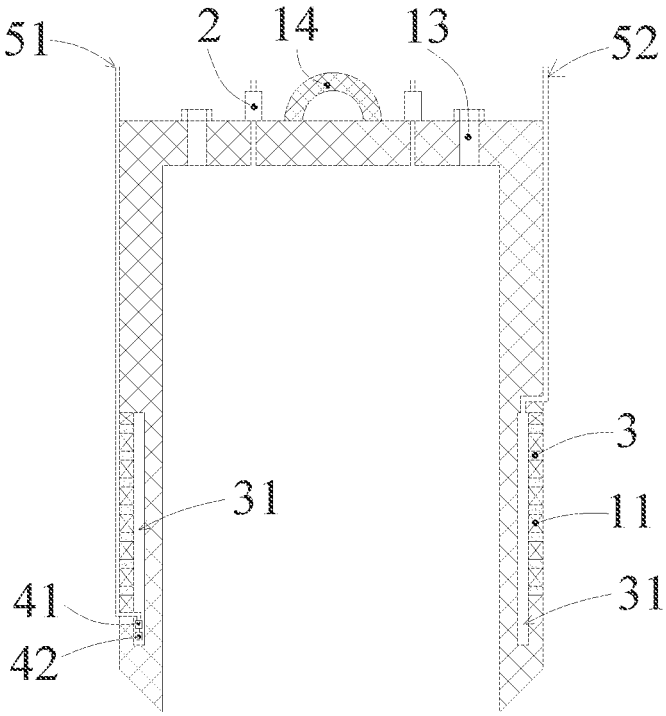
FIG. 2 is an appearance diagram of a first preferred implementation, in which the sand control device is arranged in a hole, of the exploitation device of the present invention.
Figure 3:
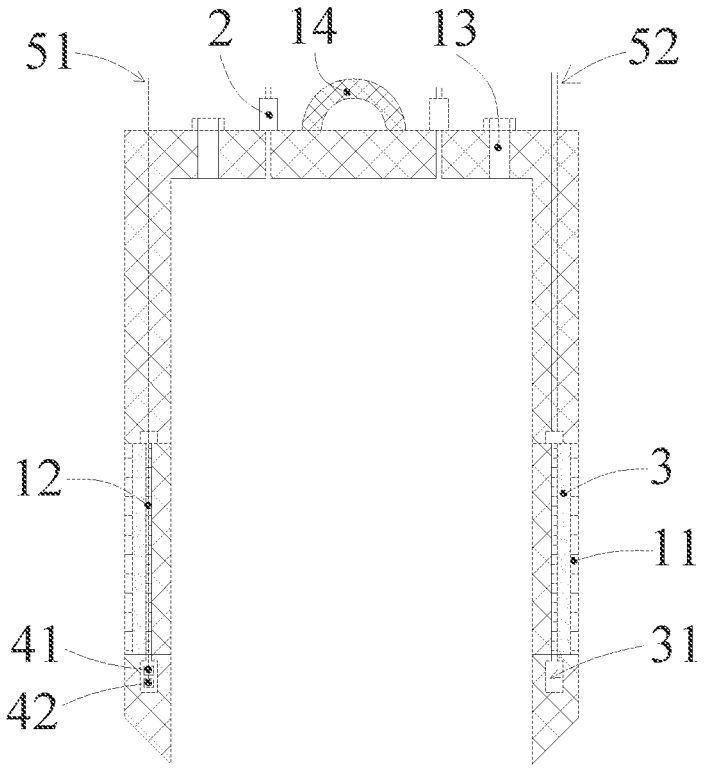
FIG. 3 is an appearance diagram of the first preferred implementation, in which the sand control device covers the hole, of the exploitation device of the present invention.
Figure 4:
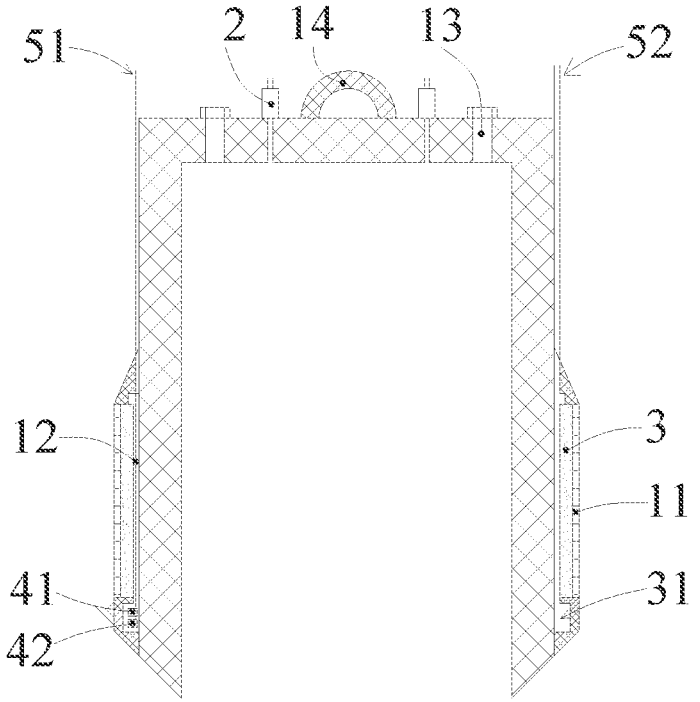
FIG. 4 is an appearance diagram of the first preferred embodiment, in which the sand control device covers the hole and is finely adjusted, of the exploitation device of the present invention.

Referring to FIG. 2-FIG. 4, as the first preferred implementation, the cavity 31 is formed in the outer side of the vertical cylinder wall of the exploitation cylinder; the exploitation cylinder further comprises a perforated pipe wall 11, and a hole is formed in the perforated pipe wall; in FIG. 2, the sand control device 3 is arranged in the hole; in FIG. 3 and FIG. 4, the sand control device 3 covers the hole, a permeable support component 12 is arranged in the cavity 31, and the permeable support component is a grid-like structure allowing liquid and gas to pass through both in the horizontal direction and in the vertical direction and can support and protect the sand control device; the perforated pipe wall has a permeable and protective function, allows liquid and gas to pass through, and protects the sand control device against erosion damage from the formation pressure and fluid; and the gas and liquid enter the cavity in the outer side of the vertical cylinder wall through the perforated pipe wall and the sand control device.

Figure 5:
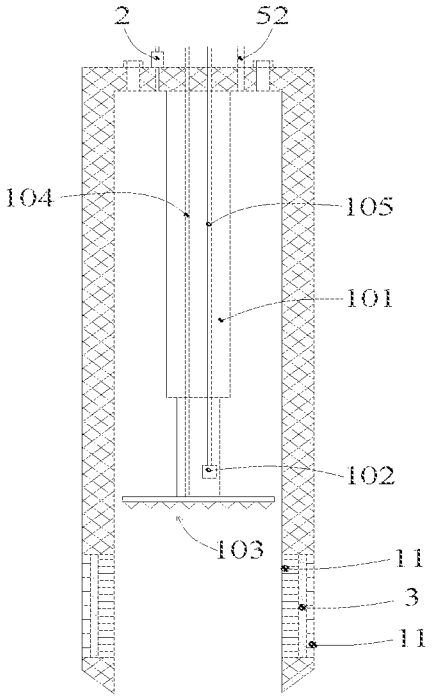
FIG. 5 is an appearance diagram of the second preferred implementation of the exploitation device in the construction process of the present invention.
Figure 6:
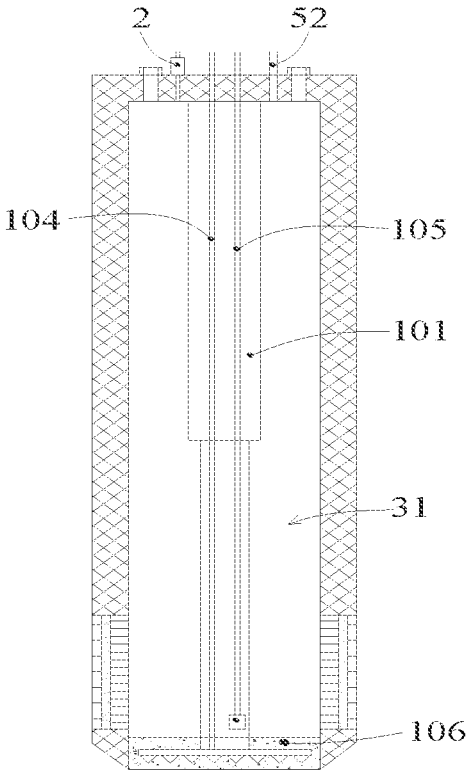
FIG. 6 is a schematic diagram of the second preferred implementation, in which the sand control device covers a hole, of the exploitation device of the present invention.
Figure 7:
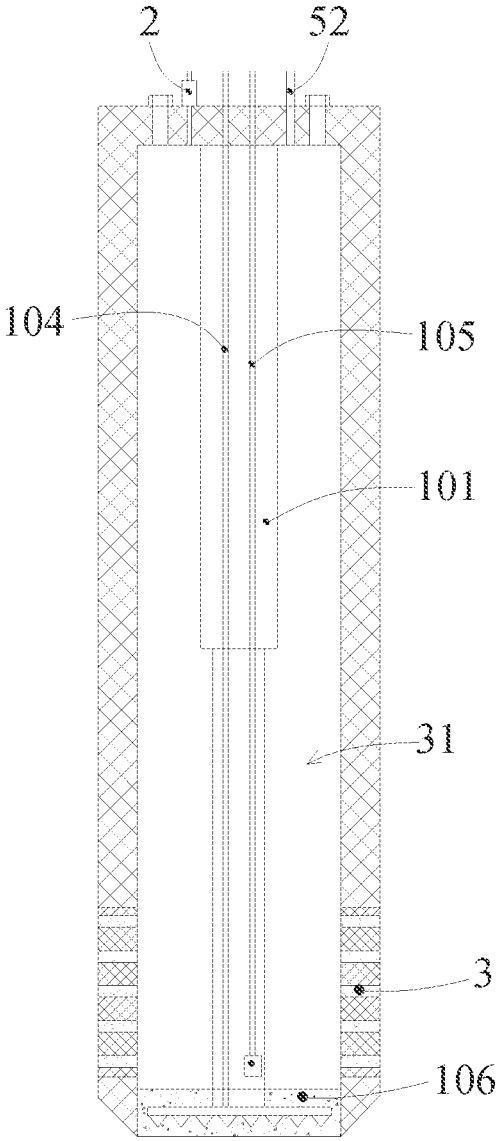
FIG. 7 is a schematic diagram of the second preferred implementation, in which the sand control device is arranged in the hole, of the exploitation device of the present invention.

Referring to FIG. 5-FIG. 7, as the second implementation, the cavity 31 is formed in an internal space of the exploitation cylinder, a stratum in the internal space is cleared out of the exploitation cylinder through a jet drilling system, and the cavity is defined by the top plate, the vertical cylinder wall and a sealing bottom of the exploitation cylinder; a hole is formed in a lower portion of the vertical cylinder wall; in FIG. 5, the sand control device covers the hole; in FIG. 6, the sand control device is arranged in the hole; a vertical well wall at this position has a permeable and protective function, allows liquid and gas to pass through, and protects the sand control device against erosion damage from the formation pressure and fluid; and the gas and liquid enter the cavity in the internal space of the exploitation cylinder through the vertical cylinder wail and the sand control device.

In the second implementation, the exploitation device is further provided with the jet drilling system, which is located in the cylinder body and comprises a telescopic arm fixed to a lower side of the top plate, a drilling rig, a jet system and a mud pumping system, wherein the telescopic arm has a telescopic end and can drive the drilling jig, the lower end of the jet system and the lower end of the mud pumping system to move vertically; the drilling jig is fixed to the lower end of the telescopic end, and the jet system comprises a jet pipe penetrating through the telescopic arm to extend to the drilling jig; the drilling jig and the jet system can crush the stratum in the internal space of the exploitation cylinder into rock debris; the mud pumping system is used to pump the rock debris out of the exploitation cylinder and comprises a mud pump fixed to the telescopic end, and the mud pump is provided with a mud output pipe extending to a position above the top plate of the exploitation cylinder; when the exploitation cylinder sinks to a desired position in the stratum and the stratum in the internal space of the exploitation cylinder is cleared out of the exploitation cylinder, the jet system is Controlled to jet curing materials that can seal the bottom of the cylinder to form the sealing bottom, and the cavity is defined by the top plate, the vertical cylinder wall and the sealing bottom of the exploitation cylinder; during exploitation, the mud pump is used as the lifting power device to discharge liquid out of the cavity through the mud output pipe, and gas in the cavity flows upwards through the gas pipe; and in this embodiment, the drilling jig crushes the stratum electrically, pneumatically or hydraulically, and the crushed rock debris is discharged via an inlet end, located in the internal space, of the mud pump.

The above two solutions are merely preferred embodiments. One or both of these two embodiments, or other easily achievable embodiments can be used in actual application.

As another solution, the water pump 2 is directly used as the lifting power device 41 of the gas-liquid lifting system.

In the above embodiments, the exploitation cylinder is an equal-diameter or variable-diameter cylinder, a skirted cylinder, or a polygonal cylinder; a main part of the exploitation cylinder is made of a high-strength prefabricated structure such as steel or reinforced concrete, and thus is high in overall strength and rigidity and will not be destroyed under a high crustal stress condition; the exploitation cylinder is further provided with a connecting component 14 connected to an anchor cable; the exploitation cylinder sinks by means of a pressure difference between the interior and the exterior of the cylinder and by gravity, and may be also provided with a high-frequency vibration device which can increase the sinking depth and speed of the exploitation cylinder; a permeable opening and a sealing cover for sealing the permeable opening are arranged at the top of the exploitation cylinder; when the exploitation cylinder descends in sea water, the sealing cover can be opened to reduce the descending resistance of the exploitation cylinder; and when the exploitation cylinder reaches the seabed, the sealing cover is closed.

When the exploitation device works, the exploitation cylinder is constructed by means of an offshore support system which adopts an offshore transport device such as a ship 107 or an offshore platform; the offshore processing system comprises a gas drying device, a gas compression device and a gas cylinder, is arranged on the offshore support system and is used the process, store and transport natural gas; the anchor cable system 108 is used to lower, lift and move the exploitation cylinder and comprises a cable and a cable control device, one end of the cable is connected to the top of the exploitation cylinder, and the other end of the cable is connected to the cable control device; and the cable control device is arranged on the offshore support system. The offshore support system and the offshore processing system are post-treatment facilities used for oil and gas exploitation.

Of course, the suction cylinder exploitation device for marine natural gas hydrates further comprises a power supply system and a control system, wherein the power supply system provides power for exploitation, and the control system controls the operation of all devices. The exploitation cylinder may also be provided with a measurement element such as a temperature sensor, a pressure sensor, a water flowmeter or a gas flowmeter.

The suction cylinder exploitation device for marine natural gas hydrates further comprises a rotary bucket auxiliary descending system which comprises a rotary bucket and a motor, wherein the rotary bucket is circular, the diameter of the rotary bucket is equal to that of the opening of the exploitation cylinder, the upper side of the rotary bucket is fixedly embedded in the bottom end of the exploitation cylinder through a concave-convex groove, an upper gear of the rotary bucket is matched with a gear of a power output shaft of the motor, and a lower gear of the rotary bucket is used to scratch and squeeze the stratum; when the hardness of the natural gas hydrate reservoir is large or the exploitation cylinder encounters a hard barrier in the descending process, the motor drives the rotary bucket to crush the stratum below the exploitation cylinder by squeezing and scratching so as to assist the exploitation cylinder in descending.

Figure 8:
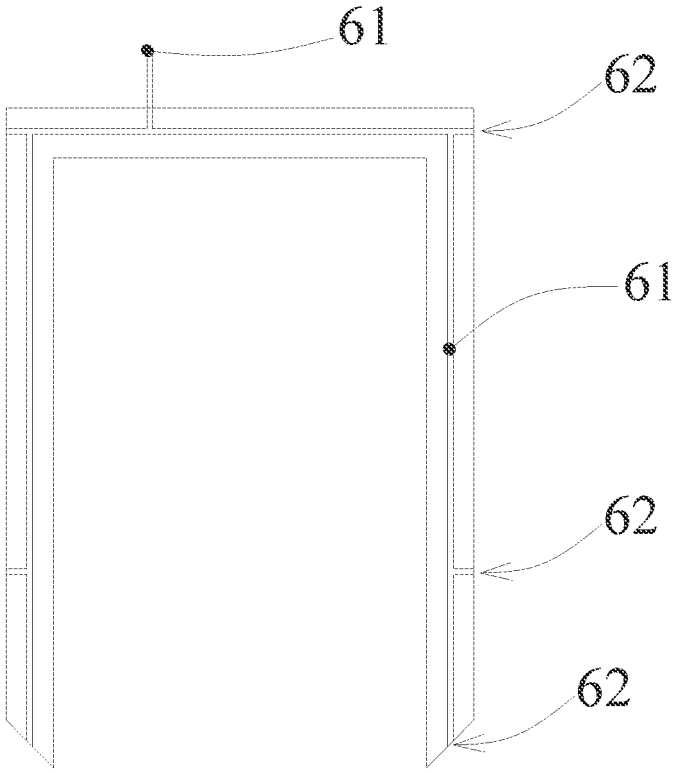
FIG. 8 is a schematic diagram of a preferred implementation of the jet injection system of the present invention.

As shown in FIG. 8, on the basis of any one of the above embodiments, the suction cylinder exploitation device for marine natural gas hydrates further comprises a jet injection system which comprises a driving device, a pipe and jet orifices, wherein driving device provides injection power for the jet injection system; the jet injection system is used (1) to jet water to the reservoir around the exploitation cylinder, when the natural gas hydrate decomposition range is insufficient, to enlarge a decomposition surface by water jet cutting so as to improve the exploitation efficiency; (2) to jet water to the position below the exploitation cylinder, when the exploitation cylinder cannot reach a desired depth through a conventional method in case where the hardness of the natural gas hydrates is high, so as to prompt the exploitation cylinder to further descend by jet water cutting; (3) to inject hot seawater, carbon dioxide or a chemical inhibitor into an exploitation range to promote the natural gas hydrates decompose; (4) to jet water to reduce silt around the exploitation device to improve the permeability; (5) to inject carbon dioxide to the position above the reservoir to form carbon dioxide hydrates by the carbon dioxide and water around to improve the formation strength above the reservoir so as to improve the stability of the reservoir.

Figure 9:
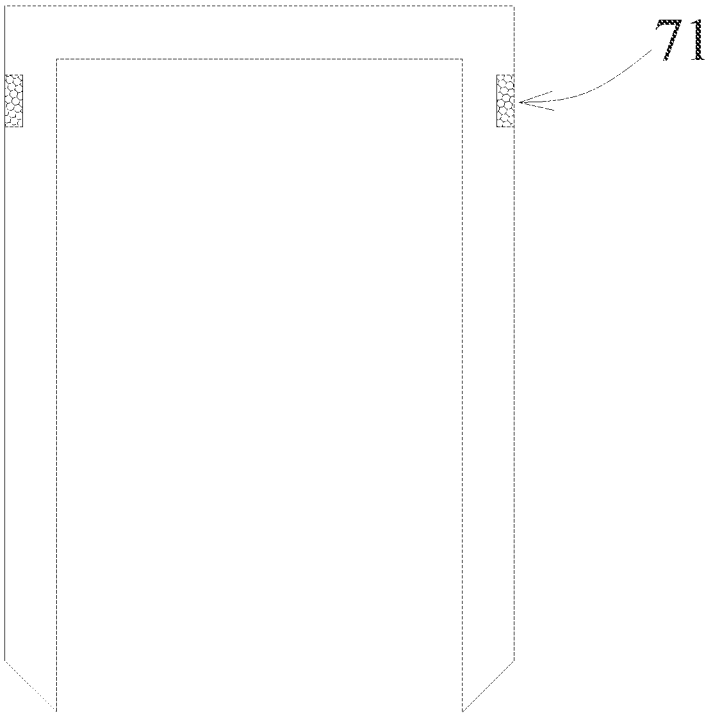
FIG. 9 is a schematic diagram of a preferred implementation of the expansion bag sealing system of the present invention.

As shown in FIG. 9, on the basis of any one of the above embodiments, the suction cylinder exploitation device for marine natural gas hydrates farther comprises an expansion bag sealing system which comprises a water-filling expansion bag and a water injection system, wherein the water injection system is communicated with a pipeline to inject water into the water-filling expansion bag, the water-filling expansion bag is fixed around the exploitation cylinder and is closely attached to the natural gas hydrate reservoir after being filled with water; the water injection system is supplied with injection power by the lifting power device of the gas-liquid lifting system to inject part of the formation fluid into the water-filling expansion bag through an auxiliary pipeline; under some geological conditions, a water passage may exist between the outer surface of the exploitation cylinder and the stratum around, and the expansion bag sealing system can reduce the influence of water and gas flowing in the water passage on the depressurizing exploitation effect in the cylinder; and the expansion bag sealing system can also cooperate with the jet injection system to carry out hydraulic fracturing to expand the exploitation range, specifically, the water-filling expansion bag is closely attached to the natural gas hydrate reservoir to seal the water passage between the outer surface of a self-entry structural body and the stratum around, and then high-pressure water containing solid particles is injected into the stratum around through the jet injection system; under the effect of the high-pressure water, the natural gas hydrate reservoir fracture, and then the jet injection system is closed; the solid particles will be filled in factures to prevent the fractures from closing completely to form seepage channels, so that the exploitation efficiency is improved, and the exploitation range is expanded.

Figure 10:
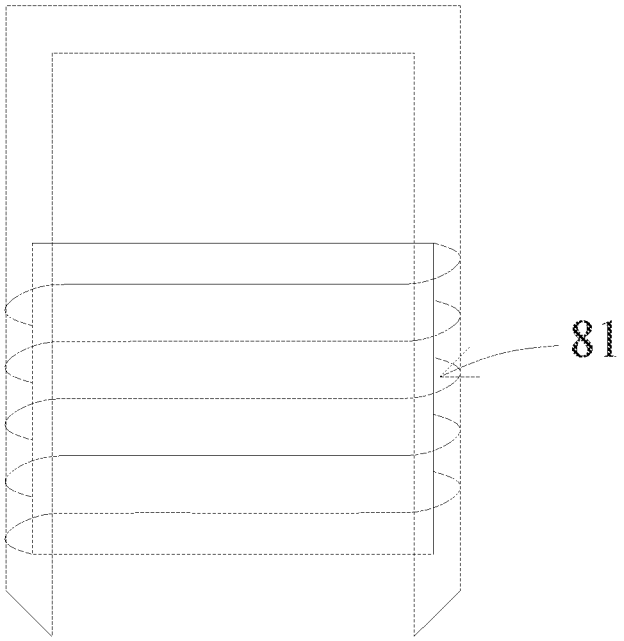
FIG. 10 is a schematic diagram of a preferred implementation of the auxiliary heating system of the present invention.

As shown in FIG. 10, on the basis of any one of the above embodiments, the suction cylinder exploitation device for marine natural gas hydrates further comprises an auxiliary heating system which adopts electric heating wire heating, electromagnetic heating and microwave heating and can improve the decomposition speed of natural gas hydrates and prevent secondary generation of hydrates. In the solution of electromagnetic heating, the auxiliary heating system comprises an electromagnetic induction coil and an electromagnetic heating controller, wherein the electromagnetic induction coil surrounds the cylinder body of the exploitation cylinder, and the electromagnetic heating controller controls the electromagnetic induction coil to heat the exploitation cylinder which is typically made of steel to realize high heat conversion and transfer efficiency, so that the natural gas hydrate reservoir can he heated on a large scale, the decomposition speed of the natural gas hydrates is improved, and secondary generation of natural gas hydrates is prevented; and due to the lack of a large steel structure in a traditional wellbore, it is hard to realize large-scale heating of the natural gas hydrate reservoir based on the electromagnetic principle.

Figure 11:
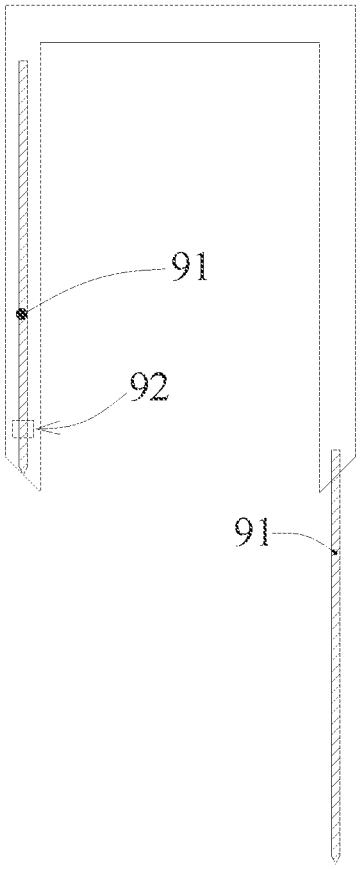
FIG. 11 is a schematic diagram of a preferred implementation of the extensible exploitation system of the present invention.
Figure 12:
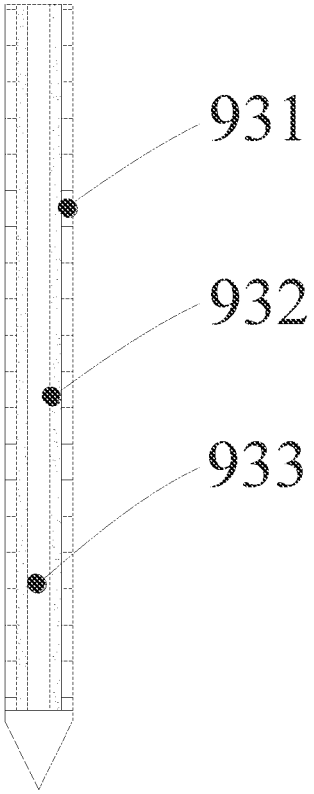
FIG. 12 is a schematic diagram of a preferred implementation of the feeler lever of the extensible exploitation system of the present invention.

As shown in FIG. 11-FIG. 12, the suction cylinder exploitation device for marine natural gas hydrates further comprises an extensible exploitation system which is a vertical feeler lever fixed to the bottom of the exploitation cylinder, and the feeler lever is composed of a permeable pipe wall, the sand control device arranged in the permeable pipe wall, and a flow passage located in the middle of the sand control device; the submerged depth of the feeler lever is greater than that of the exploitation cylinder, so that deeper formation fluid can be guided to enter the cavity, thus expanding the exploitation scope and efficiency; and an electric cylinder or a hydraulic cylinder may he arranged to drive the feeler lever to move vertically.

A first preferred embodiment of an exploitation method adopting the first implementation of the exploitation device comprises the following steps:

(1) An exploitation area is selected, and the exploitation cylinder is lowered and laid on the seabed with the aid of the offshore support system and the anchor cable system;

(2) Liquid in the exploitation cylinder is discharged through the water pump to reduce the pressure in the exploitation cylinder, the exploitation cylinder sinks under the effect of the pressure difference to enter, together with the gas-liquid lifting system and the sand control device, the natural gas hydrate reservoir and/or the natural gas hydrate and free gas mixture reservoir and/or the free natural gas reservoir;

(3) Liquid and/or gas in the cavity defined by the exploitation cylinder and the sand control device is lifted by the gas-liquid lifting system to reduce the pressure in the cavity, the pressure of the stratum around is reduced to promote natural gas hydrates ID the stratum to be decomposed into water and natural gas, which enter the cavity through the sand control device under the effect of the pressure difference; then, the liquid and the natural gas are lifted synchronously, wherein the fluid is lifted to the sea surface or the offshore processing system, and the gas is lifted to the offshore processing system, so that exploitation of the natural gas hydrates is realized; when the natural gas hydrates within a certain range are exploited or the gas production efficiency is reduced to a certain value, gas-liquid lifting is stopped, water is pumped into the exploitation cylinder through the water pump until the pressure inside the exploitation cylinder is higher than the pressure outside the exploitation cylinder, and the exploitation cylinder is pulled by the anchor cable system to rise above a mud line under the effect of the pressure difference and is then withdrawn or transferred to a new exploitation area for exploitation.

A second preferred embodiment of the exploration method using the second implementation of the exploitation device comprises the following steps;

(1) An exploitation area is selected, and the exploitation cylinder is lowered and laid on the seabed with the aid of the offshore support system and the anchor cable system;

(2) Liquid in the exploitation cylinder is discharged through the water pump to reduce the pressure in the exploitation cylinder, the exploitation cylinder sinks under the effect of the pressure difference, and the rock-soil body in the exploitation cylinder is crushed and discharged out of the cylinder by the jet drilling system when the exploitation cylinder is controlled to sink; the exploitation cylinder enters, together with the gas-liquid lifting system and the sand control device, the natural gas hydrate reservoir and/or the natural gas hydrate and free gas mixture reservoir and/or the free natural gas reservoir;

(3) When the exploitation cylinder sinks to a desired position in the stratum and the stratum in he internal space of the exploitation cylinder is cleared out of the cylinder, and the jet system is controlled to jet curing materials that can seal the bottom of the cylinder to form the sealing bottom; after the bottom of the cylinder is sealed, the mud pump is used as the lifting power device to discharge liquid in the cavity through the mud output pipe to reduce the pressure in the cavity, the pressure of the stratum around is reduced to promote the natural gas hydrates in the stratum around to be decomposed into water and natural gas, which enter the cavity through the sand control device under the effect of the pressure difference, wherein liquid in the cavity is lifted to the sea surface or the offshore processing system, and gas flows upward into the offshore processing system through the gas pipe, so that exploitation of the natural gas hydrates is realized.

In the case where the thickness of the hydrate reservoir is large, exploitation can he carried out stage by stage. Specifically, liquid can he pumped in or out of the exploitation cylinder to control the exploitation cylinder to move upwards or downwards to realize stage-by-stage exploitation from bottom to top or from top to bottom.

In the case where an overlying stratum on the hydrate reservoir is soft, carbon dioxide is injected above/or around the exploitation cylinder by the jet injection system between Step (2) and Step (3) to form carbon dioxide hydrates by the carbon dioxide and water around form, so that the stability of the stratum is improved.

The gas-liquid lifting system can be controlled to open or close to control the water pressure in the cavity, and the pressure can be reduced to a desired value once or multiple times to adjust the production speed and stabilize the production capacity. The gas-liquid lifting system can be intermittently started to exploit the hydrates intermittently. When the temperature of the reservoir is too low, exploitation is carried out alter the temperature rises again, so that the exploitation efficiency can be improved.

The jet injection system and the expansion bag sealing system are used in cooperation to carry out hydraulic fracturing within the exploitation range to enable the natural gas hydrate reservoir to fracture, so that the exploitation efficiency is further improved.

The expansion bag sealing system can he started to inject water into the water-filling expansion hag, so that the water-filling expansion hag expands to be closely attached to the natural gas hydrate reservoir to seal the water passage between the outer surface of the self-entry structural body and the stratum around; then, the jet injection system injects high-pressure water containing solid particles into the stratum around; the natural gas hydrate reservoir fractures under the effect of the high-pressure water, and then the jet injection system is closed; and the solid particles will filled in fractures to prevent them from closing completely to form seepage channels, so that the exploitation efficiency is improved, and the exploitation range is expanded, Multiple exploitation devices can be used for exploitation at the same time to realize mass exploitation, and natural gas exploited by the exploitation devices is collected by a relay station and is then lifted to the offshore processing system.

During mass exploitation, adjacent exploitation devices may cooperate to early out hydraulic fracturing to improve the production, and other adjacent exploitation devices may cooperate to carrying out heating to improve the production, that is, part of the exploitation devices are used to heat the natural gas hydrate reservoir, and the other part of adjacent exploitation devices are used for exploitation. These exploitation devices can be used alternately.

Terms for describing positional relations or shapes in any one of technical solutions disclosed above include approximate, similar or close states or shapes. The above embodiments are merely used to explain the technical solutions of the invention, but are not intended to limit the invention. Modifications of the specific implementations of the invention or equivalent substitutions of part of the technical features of the invention obtained without departing from the spirit of the technical solutions of the invention should also fall within the protection scope of the technical solutions of the invention.

What is claimed is:

1. A suction cylinder exploitation device for marine natural gas hydrates, comprising an exploitation cylinder capable of sinking into a stratum below a seabed, a water pump, a sand control device and a gas-liquid lifting system, wherein:

the exploitation cylinder is a cylindrical structure with an upper side sealed and a lower side not sealed, and comprises a top plate and a vertical cylinder wall; the water pump is communicated with an inner cavity of a cylinder body and is able to discharge liquid out of the exploitation cylinder to reduce a pressure in the exploitation cylinder, controlling the sinking of the exploitation cylinder in the formation and carrying the sand control device and the gas-liquid lifting system into one or any combination of a natural gas hydrate reservoir, a natural gas hydrate and free gas mixture reservoir, and a free natural gas reservoir below the seabed;

at least one cavity enclosed between the exploitation cylinder and the sand control device, and the sand control device allows one or both combinations of liquid, gas to pass through to enter the cavity and is able to filter out silt; the cavity is communicated with at least one channel;

the gas-liquid lifting system comprises at least one lifting power device, which has an end connected to the cavity and an end connected to an offshore processing system, and is used to lift one or both combinations of the liquid, gas in the cavity; when the liquid and/or gas is lifted, a pressure in the cavity is reduced to reduce a pressure of the stratum around to promote natural gas hydrates to be decomposed into water and natural gas, which enter the cavity through the sand control device under the effect of a pressure difference, so that exploitation of the natural gas hydrates is realized;

the channel includes a water pipe and a gas pipe; the water pipe has an end connected to the lifting power device and an end connected to an upper portion of the exploitation cylinder; the gas pipe has an end connected to the cavity and an end connected to an upper portion of the exploitation cylinder to collect gas; under the effect of formation pressure and gravity, formation fluid enters the cavity, the liquid in the cavity flows downward and is pressed into the water pipe to be lifted by the lifting power device; the gas in the cavity flows upwards through the gas pipe; the lifting power device is an electric pump, and the electric pump is an electric immersible centrifugal pump, an electric immersible screw pump, a mud pump, or a combination of these three pumps;

The cavity is formed in an outer side of the vertical cylinder wall of the exploitation cylinder or in an internal space of the exploitation cylinder;

When the cavity is formed in an outer side of the vertical cylinder wall of the exploitation cylinder; the exploitation cylinder has a perforated pipe wall, and a hole is formed in the perforated pipe wall; the sand control device is one or both combinations arranged in the hole, covering the hole; the perforated pipe wall has a permeable and protective function, allows liquid and gas to pass through, and protects the sand control device against erosion damage from the formation pressure and fluid; and the gas and liquid enter the cavity in the outer side of the vertical cylinder wall through the perforated pipe wall and the sand control device;

When the cavity is formed in an internal space of the exploitation cylinder, the stratum in the internal space is cleared out of the cylinder through a jet drilling system, and the cavity is defined by the top plate, the vertical cylinder wall and a sealing bottom of the exploitation cylinder; a hole is formed in a lower portion of the vertical cylinder wall, the sand control device is one or both combinations arranged in the hole, covering the hole; a vertical well wall at this position has a permeable and protective function, allows liquid and gas to pass through, and protects the sand control device against erosion damage from the formation pressure and fluid; and the gas and liquid enter the cavity in the internal space of the exploitation cylinder through the vertical well wall and the sand control device.

2. The suction cylinder exploitation device for marine natural gas hydrates as claimed in claim 1, wherein the jet drilling system comprises a telescopic arm fixed to a lower side of the top plate, a drilling jig, a jet system and a mud pumping system; the telescopic arm has a telescopic end and is able to drive the drilling jig, a lower end of the jet system and a lower end of the mud pumping system to move vertically; the drilling jig is fixed to a lower end of the telescopic end, and the jet system comprises a jet pipe penetrating through the telescopic arm to extend to the drilling jig; the drilling jig and the jet system are able to crush the stratum in the internal space of the exploitation cylinder into rock debris; the mud pumping system is used to pump the rock debris out of the exploitation cylinder and comprises a mud pump fixed to the telescopic end, and the mud output pipe extending to a position above the top plate of the exploitation cylinder is disposed at a discharge end of the mud pump; when the exploitation cylinder sinks to a desired position in the stratum and the stratum in the internal space of the exploitation cylinder is cleared out of the cylinder, the jet system is controlled to jet curing materials which are able to seal a bottom of the cylinder to form the sealing bottom; and the mud pump is used as the lifting power device to discharge the liquid out of the cavity through the mud output pipe, and the gas in the cavity flows upwards through the gas pipe.

3. The suction cylinder exploitation device for marine natural gas hydrates as claimed in claim 1, further comprising a jet injection system which comprises an injection pump, a pipe embedded in the exploitation cylinder, and jet orifices formed in an outer surface of the exploitation cylinder and communicated with the jet pipe, wherein the injection pump jets water, hot seawater, carbon dioxide or a chemical inhibitor to the stratum via the jet orifices through the jet pipe.

4. The suction cylinder exploitation device for marine natural gas hydrates as claimed in claim 1, further comprising an expansion bag sealing system which comprises a water-filling expansion bag and a water injection system, and the water injection system injects water into the water-filling expansion bag; and the water-filling expansion bag is circular, is fixed to an upper portion of a periphery of the exploitation cylinder, and is closely attached to the natural gas hydrate reservoir after being filled with water.

5. The suction cylinder exploitation device for marine natural gas hydrates as claimed in claim 1, further comprising an auxiliary heating system which comprises an electromagnetic induction coil and an electromagnetic heating controller, the electromagnetic induction coil surrounds the cylinder body of the exploitation cylinder, and the electromagnetic heating controller controls the electromagnetic induction coil to heat the exploitation cylinder, so that the natural gas hydrate reservoir is heated on a large scale.

6. The suction cylinder exploitation device for marine natural gas hydrates as claimed in claim 1, further comprising an extensive exploitation system which is a vertical feeler lever fixed to a bottom of the exploitation cylinder, and the feeler lever is composed of a permeable pipe wall, the sand control device arranged in the permeable pipe wall, and a flow passage located in a middle of the sand control device; a submerged depth of the feeler lever is greater than that of the exploitation cylinder to guide deeper formation fluid to enter the cavity, so that the exploitation range is expanded, and the exploitation efficiency is improved; and an electric cylinder or a hydraulic cylinder is arranged to drive the feeler lever to move vertically.

7. A suction cylinder exploitation method for marine natural gas hydrates adopting the exploitation device as claimed according to claim 1, comprising the following steps:

(1) selecting an exploitation area, dragging the exploitation cylinder into the exploitation area by means of an offshore transport device, and lowering the exploitation cylinder on the seabed through a rope;

(2) discharging liquid out of the exploitation cylinder by the water pump to reduce the pressure in the exploitation cylinder, so that the exploitation cylinder sinks under the effect of the pressure difference to enter, together with the gas-liquid lifting system and the sand control device, the natural gas hydrate reservoir and/or the natural gas hydrate and free gas mixture reservoir and/or the free natural gas reservoir below the seabed;

(3) lifting, by the gas-liquid lifting system, the liquid and/or gas in the cavity defined by the exploitation cylinder and the sand control device to reduce the pressure in the cavity, so that the pressure of the stratum around is reduced to promote the natural gas hydrates in the stratum around to be decomposed into water and natural gas, which enter the cavity through the sand control device under the effect of the pressure difference, and then the liquid and the natural gas are lifted out of the exploitation cylinder synchronously, so that exploitation of the natural gas hydrates is realized.

8. The suction cylinder exploitation method for marine natural gas hydrates as claimed in claim 7, wherein in case where the cavity is formed in the internal space of the exploitation cylinder, a rock-soil body in the exploitation cylinder is crushed by the jet drilling system and is discharged out of the cylinder body when the exploitation cylinder is controlled to sink; when the exploitation cylinder sinks to a desired position in the stratum and the stratum in the internal space of the exploitation cylinder is cleared out of the cylinder, the jet system is controlled to jet curing materials that are able to seal the bottom of the cylinder to form the sealing bottom; and when exploitation is carried out after the bottom of the cylinder is sealed, the mud pump is used as the lifting power device to discharge the liquid out of the cavity through the mud output pipe, and the gas in the cavity flows upwards through the gas pipe.

9. The suction cylinder exploitation method for marine natural gas hydrates as claimed in claim 7, wherein when natural gas hydrates within a certain range are exploited or the gas production efficiency is reduced to a certain value, gas-liquid lifting is stopped, water is pumped into the exploitation cylinder by the water pump until the pressure inside the exploitation cylinder is greater than the pressure outside the cylinder; and under the effect of the pressure difference, the exploitation cylinder is pulled by the anchor cable system to rise above a mud line to be withdrawn or transferred to a new exploitation area for exploitation.

* * * * *